US006094859A

United States Patent [19]

Kalman et al.

[11] Patent Number: 6,094,859

[45] **Date of Patent: *Aug. 1, 2000**

[54] TREE STAND

[75] Inventors: Jeffrey M. Kalman, Cleveland Heights; John R. Nottingham, Hunting Valley; Jeffrey S. Plantz, Seven Hills; Paul A. Tamulewicz, Parma, all of Ohio

[73] Assignee: Minami International Corp., Yonkers, N.Y.

[ * ] Notice: This patent is subject to a terminal disclaimer.

[21] Appl. No.: 08/577,456

[22] Filed: Dec. 22, 1995

Related U.S. Application Data

[63] Continuation of application No. 08/069,013, May 28, 1993, Pat. No. 5,507,117.

[51] Int. Cl.[7] ..... A47G 33/12; A47G 7/02; F16M 13/00

[52] U.S. Cl. ..... 47/40.5; 248/516; 248/416; 248/525

[58] Field of Search ..... 248/516, 525, 248/416; 47/40.5

[56] References Cited

U.S. PATENT DOCUMENTS

| | | |
|---|---|---|
| D. 258,780 | 4/1981 | Wasserman . |
| D. 329,622 | 9/1992 | Smith . |
| D. 332,582 | 1/1993 | Quinn . |
| D. 339,549 | 9/1993 | Hermanson . |
| D. 342,694 | 12/1993 | Frost . |
| D. 344,250 | 2/1994 | Johnson et al. . |
| D. 344,911 | 3/1994 | Stork . |
| D. 345,943 | 4/1994 | Lujan, Jr. . |
| D. 347,599 | 6/1994 | Johnson et al. . |
| D. 349,259 | 8/1994 | Adam . |
| D. 350,915 | 9/1994 | Stork . |
| D. 351,570 | 10/1994 | Fillipp . |
| D. 353,788 | 12/1994 | Frost . |
| D. 354,021 | 1/1995 | Kielbasa . |
| 868,568 | 10/1907 | Jones . |
| 1,224,607 | 5/1917 | Craven . |
| 1,253,572 | 1/1918 | Buchanan . |
| 1,551,093 | 8/1925 | Fletcher . |
| 1,615,621 | 1/1927 | Goodnow . |
| 1,855,762 | 4/1932 | Kaminski . |
| 1,997,870 | 4/1935 | Merrill . |
| 2,044,192 | 8/1936 | Templin, Jr. . |
| 2,337,914 | 12/1943 | Meldrum . |
| 2,493,633 | 1/1950 | Mart . |
| 2,587,788 | 3/1952 | Tacy . |
| 2,605,067 | 7/1952 | Lindsell . |
| 2,609,169 | 9/1952 | Kroeger . |
| 2,733,032 | 1/1956 | Farley et al. . |
| 2,812,916 | 11/1957 | Jonasson et al. . |
| 2,905,414 | 9/1959 | Zierden . |
| 2,915,620 | 12/1959 | Robinson . |
| 2,933,274 | 4/1960 | Mausolf . |
| 2,980,377 | 4/1961 | Nielsen et al. . |
| 2,994,498 | 8/1961 | Sager . |
| 2,997,264 | 8/1961 | Zelenitz . |

(List continued on next page.)

FOREIGN PATENT DOCUMENTS

| | | |
|---|---|---|
| 153889 | 8/1988 | Japan . |
| 2 115 479 | 2/1983 | United Kingdom . |

OTHER PUBLICATIONS

"Perennial Problem: How to Get a Conifer to Stand Straight," Barbara Marsh, Wall Street Journal Dec. 11, 1992.

*Primary Examiner*—Michael J. Carone
*Assistant Examiner*—Fredrick T. French, III
*Attorney, Agent, or Firm*—Amster, Rothstein & Ebenstein

[57] ABSTRACT

A Christmas tree stand which comprises a receptacle and a two-piece base is provided. The receptacle is placed over the trunk of a tree and a clamping assembly is used to secure the tree within the receptacle. The receptacle is then inserted into a top portion of the base. The top portion of the base is moveable with respect to a bottom portion of the base. A movement assembly is provided which enables one person to easily move the top portion with respect to the bottom portion. Additionally, the top portion of the base includes a cavity for holding water.

28 Claims, 12 Drawing Sheets

U.S. PATENT DOCUMENTS 3,204,898 9/1965 Manning .
3,298,642 1/1967 Taylor .
3,298,643 1/1967 Taylor .
3,715,095 2/1973 Drablowski .
3,779,493 12/1973 Gidlof .
3,783,547 1/1974 Bystrom et al. .
3,901,469 8/1975 Davis et al. .
4,126,963 11/1978 Dunbar .
4,130,965 12/1978 Patton et al. .
4,156,323 5/1979 Scheffler .
4,159,096 6/1979 Chase .
4,231,539 11/1980 Sandham .
4,254,578 3/1981 Hanfeld .
4,260,365 4/1981 Kayne .
4,261,138 4/1981 St. George Syms .
4,261,402 4/1981 Stanaitis .
4,286,409 9/1981 Taylor et al. .
4,354,654 10/1982 Werner et al. ..... 248/663
4,381,621 5/1983 Eby .
4,393,621 7/1983 Rodell .
4,397,895 8/1983 Poe .
4,408,415 10/1983 Davis et al. .
4,429,846 2/1984 Halvorson .
4,436,272 3/1984 Lile et al. .
4,541,601 9/1985 Corbisello .
4,562,988 1/1986 Bumgardner ..... 248/349
4,565,028 1/1986 Stephan .
4,571,882 2/1986 Capen .
4,596,262 6/1986 Tegze .
4,611,781 9/1986 Wiegand .
4,699,347 10/1987 Kuhnley .
4,726,553 2/1988 Wischusen, III .
4,884,363 12/1989 Sofy .
4,901,971 2/1990 Connelly .
4,936,538 6/1990 Royce .
4,967,508 11/1990 Reynolds .
4,976,411 12/1990 Gordon et al. .
5,000,414 3/1991 Rosato .
5,014,461 5/1991 vom Braucke et al. .
5,048,230 9/1991 Bernardy .
5,074,514 12/1991 Smith .
5,086,583 2/1992 Breen .
5,114,113 5/1992 Krinner .
5,121,897 6/1992 Sofy .
5,137,246 8/1992 Idso .
5,201,140 4/1993 Voorhis .
5,209,450 5/1993 Grapes .
5,236,167 8/1993 Tai et al. .
5,243,782 9/1993 Jones .
5,249,772 10/1993 Montie, Jr. et al. .
5,279,071 1/1994 McDougall .
5,290,004 3/1994 Frost et al. .
5,299,381 4/1994 Oldenburg, Jr. .
5,301,462 4/1994 Hronyetz .
5,318,267 6/1994 Rast .
5,320,323 6/1994 Clark, Jr. .
5,323,558 6/1994 Baumler .
5,327,677 7/1994 Rivera .
5,330,368 7/1994 Tsuruzono .
5,333,828 8/1994 Severeid .
5,335,730 8/1994 Cotham, III .
5,337,990 8/1994 Brown .
5,338,585 8/1994 Fraus et al. .
5,342,661 8/1994 Wilcox, II .
5,349,997 9/1994 Rial .
5,350,149 9/1994 Evans, Jr. et al. .
5,359,502 10/1994 Cantin .
5,362,024 11/1994 Grinnen .
5,363,591 11/1994 Jones .
5,369,910 12/1994 Copenhaver .
5,373,997 12/1994 Baltensperger et al. .
5,375,807 12/1994 Claas .
5,375,808 12/1994 Roy .
5,388,799 2/1995 Keefe .
5,393,031 2/1995 Leve .
5,398,444 3/1995 Murray .
5,407,168 4/1995 Shultz .
5,410,838 5/1995 O'Leary et al. .
5,454,188 10/1995 Sofy .
5,467,959 11/1995 Behringer .
5,507,117 4/1996 Kalman et al. ..... 47/40.5

TREE STAND

This is a continuation of application Ser. No. 08/069,013, filed May 28, 1993, now U.S. Pat. No. 5,507,117.

FIELD OF THE INVENTION

The present invention relates generally to a tree stand for vertically positioning a tree. More particularly, the present invention relates to a Christmas tree stand which may be easily operated by one person to vertically position a Christmas tree.

BACKGROUND OF THE INVENTION

The problem of positioning a Christmas tree within a Christmas tree stand is well known. First, utilizing a one piece stands, it is difficult, particularly for one person, to insert a tree into the stand and then secure the tree while it is in an erect position. Depending upon the size of the tree, it usually takes more than one person to lift the tree into the stand, to hold the tree upright, and to secure the tree within the stand. Further, once the tree is secured within the stand, it is difficult to adjust the tree so that it stands straight. Typically, the person straightening the tree has to adjust the tree by manipulating a mechanism on the stand. In order to do this, the person must be bent over in the vicinity of the stand. In this position, it is difficult to see whether the tree is straight. Therefore, to position the tree, the tree must first be adjusted and then viewed to see whether it is straight. Alternatively, another person has to tell the person straightening the tree whether the tree is straight.

A variety of tree stands were developed in an attempt to overcome these difficulties with one piece stands. For example, some two piece stands were developed which permit a first piece of the stand to be secured to the trunk of the tree while the tree is lying on its side. After the first piece has been secured to the trunk of the tree, the tree and the first piece of the stand may be inserted into a second piece of the stand. Further, other stands permit a single person to adjust the tree without having to bend over in the vicinity of the stand.

However, problems still exist with present day Christmas tree stands. The mechanisms which are used to secure the tree within the stand are not always sturdy enough. In addition, the mechanisms which are used to adjust the tree are not always easy to use.

SUMMARY OF THE INVENTION

The present invention provides a Christmas tree stand which permits a Christmas tree to be solidly secured within the stand and to be easily adjusted to a desired vertical position.

More particularly, the present invention provides a Christmas tree stand which comprises a receptacle and a two-piece base. The receptacle is placed over the trunk of a tree and a clamping assembly is used to secure the tree within the receptacle. The receptacle is then inserted into a top portion of the base. The top portion of the base is moveable with respect to a bottom portion of the base. A movement assembly is provided which enables one person to easily move the top portion with respect to the bottom portion. Additionally, the top portion of the base includes a cavity for holding water.

These and other features of the present invention are fully described and particularly pointed out in the claims. The following detailed description and accompanying drawings set forth in detail an illustrative embodiment. However, this embodiment is indicative of but one of the various ways in which the principles of the present invention may be employed.

DETAILED DESCRIPTION OF THE PREFERRED EMBODIMENT

Figure 1:
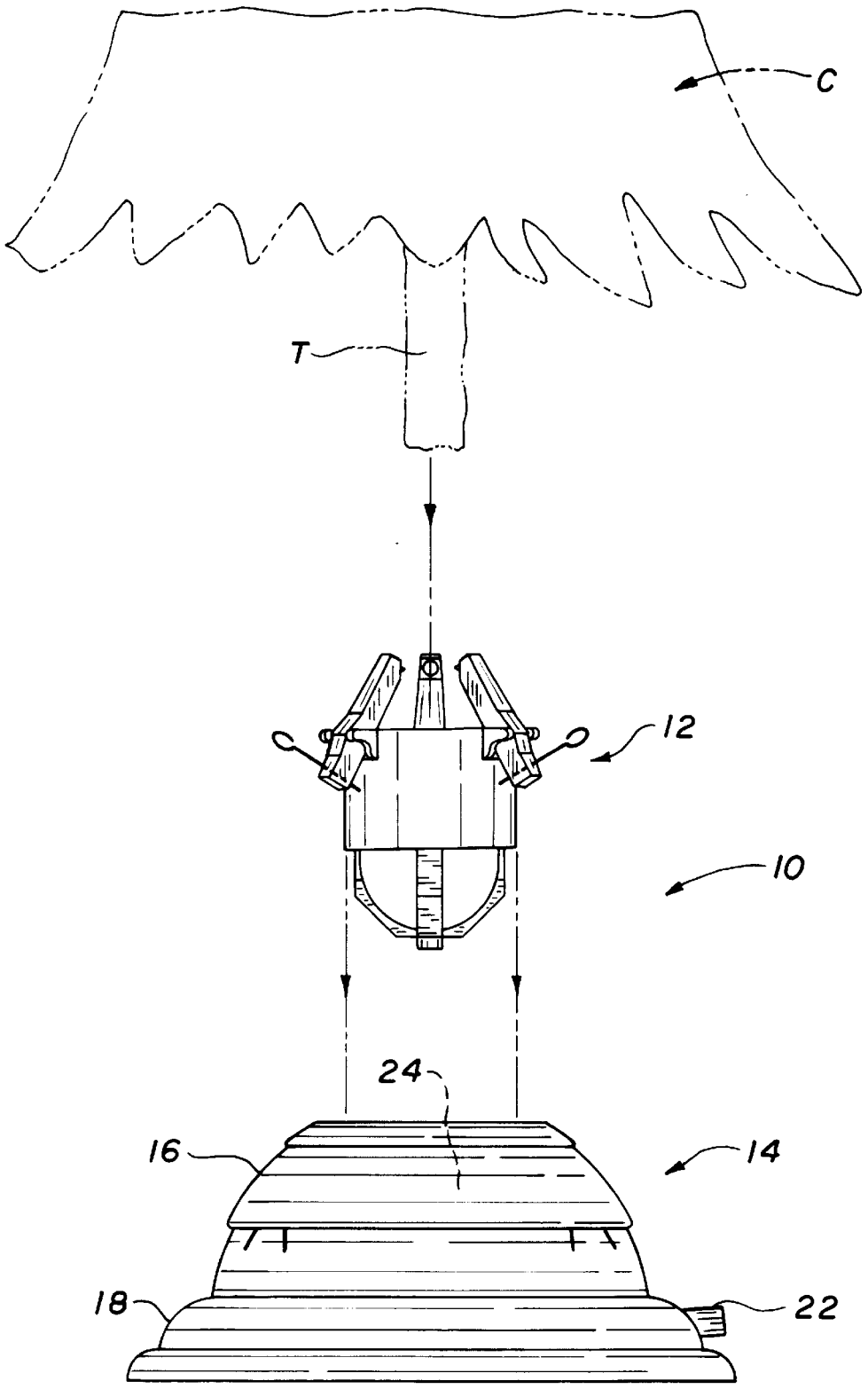
FIG. 1 is an exploded view of the components of a Christmas tree stand constructed according to the principles of the present invention.

Referring to the drawings, FIG. 1 is an exploded view of the components of a Christmas tree stand, indicated generally at reference numeral 10, constructed according to the principles of the present invention. The Christmas tree stand 10 comprises a receptacle (or container) 12 and a two-piece base 14. During use of the Christmas tree stand 10, the receptacle 12 is placed over a trunk T of a Christmas tree C. The trunk T is then secured within the receptacle 12. Next, the receptacle 12 is inserted into a top portion (or engagement section) 16 of the base 14. The top portion 16 of the base 14 is moveable with respect to a bottom portion (or foundation) 18 of the base 14.

Figure 2:
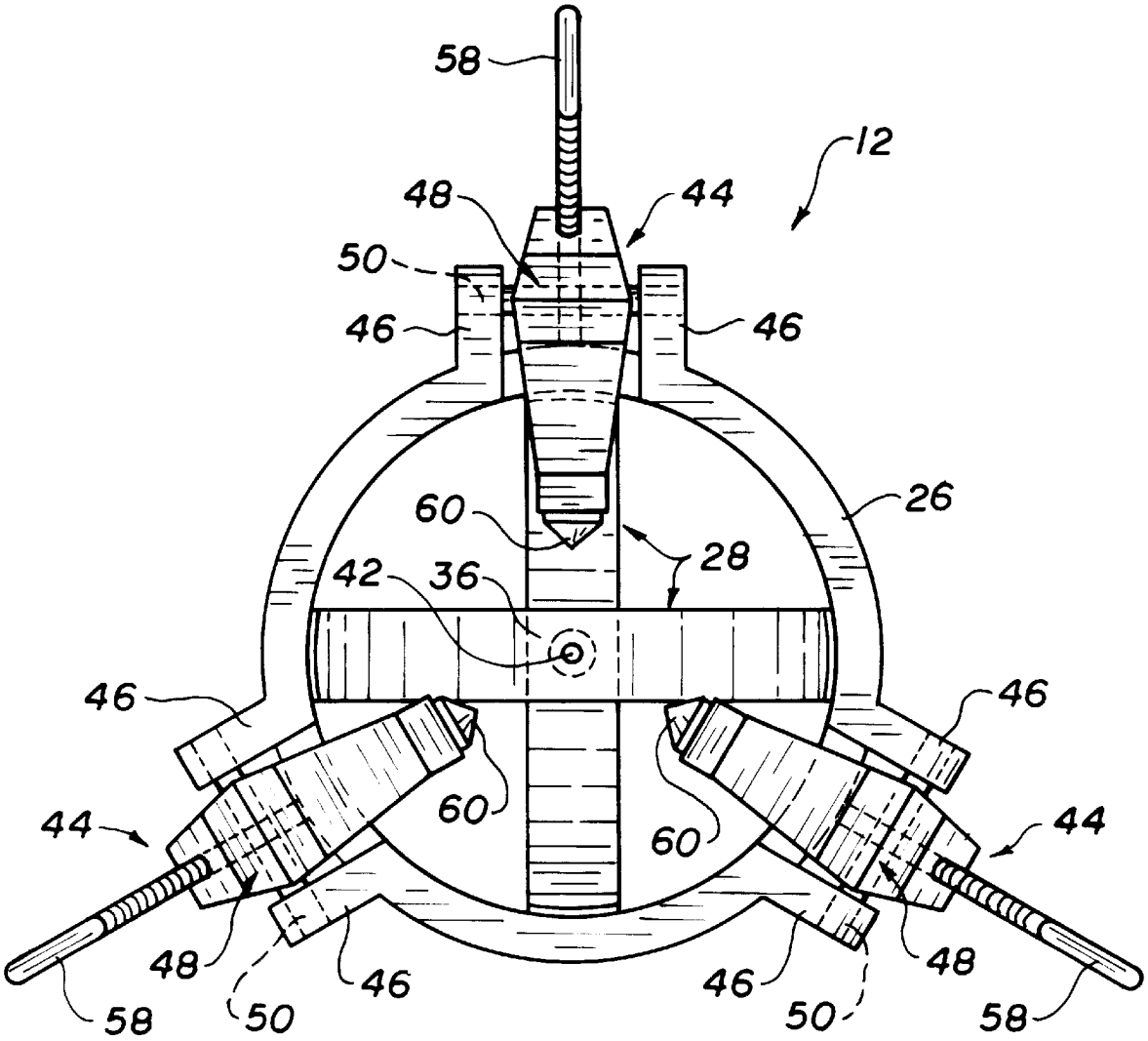
FIG. 2 is a top view of the receptacle of the Christmas tree stand of FIG. 1.
Figure 3:
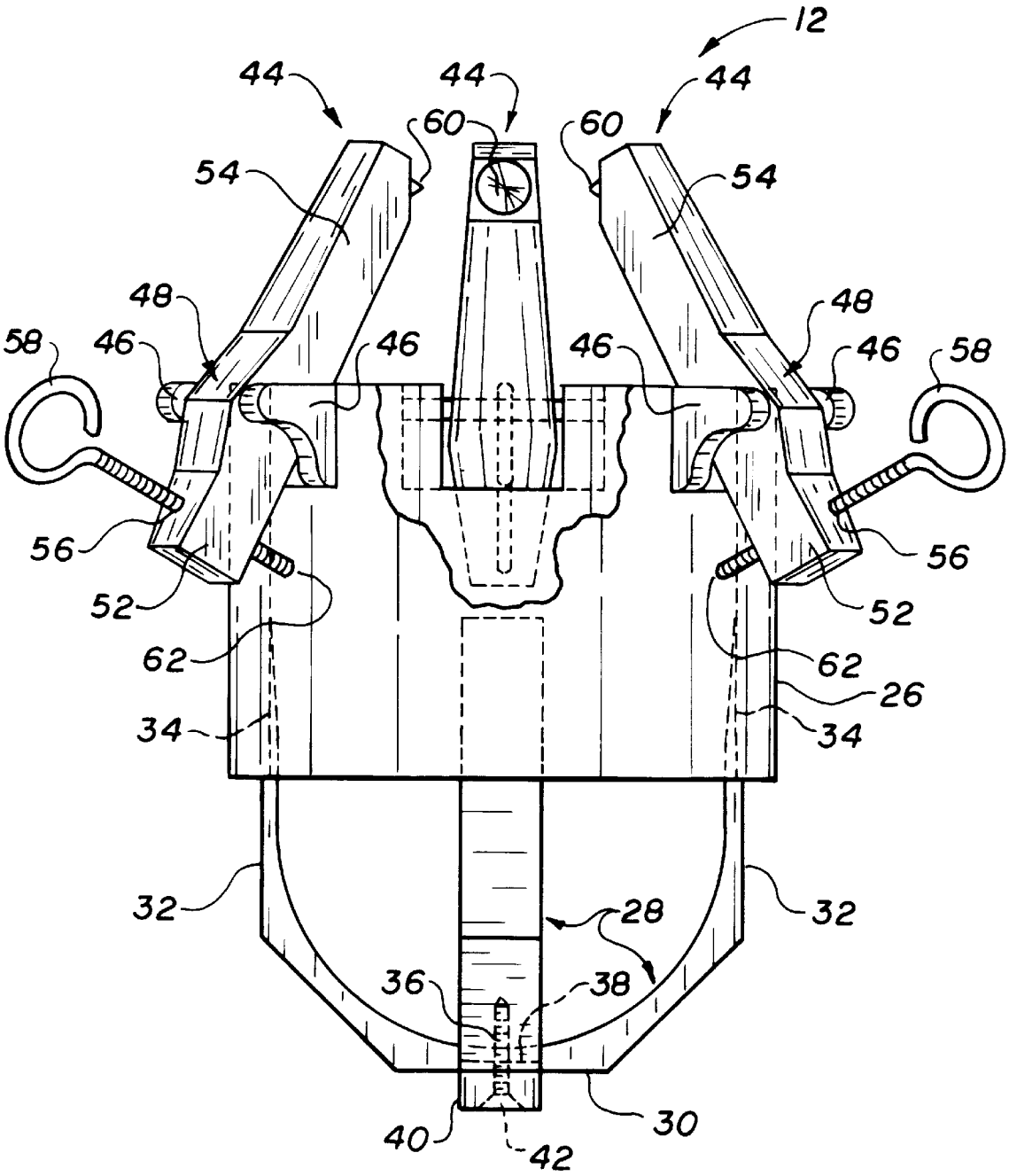
FIG. 3 is a side view of the receptacle of the Christmas tree stand of FIG. 1.

A movement assembly, indicated generally at reference numeral 20 (illustrated in FIGS. 5*a*, 5*b*, 6, 11, and 12), enables the top portion 16 to move with respect to the bottom portion 18. The movement assembly 20 includes a foot pedal 22 which may be moved between a first position and a second position. In the first position (illustrated in solid lines in FIG. 8), the top portion 16 is prevented from moving with respect to the bottom portion 18. In the second position (illustrated in phantom in FIG. 8), the top portion 16 is permitted to move freely with respect to the bottom portion 18. As further explained below, this movement involves the rotation of receptacle 12 and top portion 16 of base 12 about a center or pivot point located in a ball and socket arrangement 142/146 below the space defined in receptacle 12 for receiving the trunk T of the Christmas tree C. See FIGS. 5*a*, 5*b* and 6. As is readily appreciated, such rotational movement causes the sides of receptacle 12 (e.g. annular sleeve 26 as shown in FIGS. 2 and 3) to undergo transverse movement with respect to the center or pivot point about which the receptacle rotates. Additionally, the top portion 16 of the base 14 includes a cavity 24 for holding water.

As illustrated in FIGS. 2 and 3, the receptacle 12 receives the trunk T of the Christmas tree C. Receptacle 12 includes an annular sleeve 26 which substantially surrounds the trunk T of the Christmas tree C. U-shaped members 28 are attached to the sleeve 26 and extend downwardly therefrom. Each U-shaped member 28 has a central portion 30 and side portions 32 extending upwardly from the central portion 30. The side portions 32 are attached to an inner lower portion 34 of the sleeve 26. The side portions 32 are circumferentially spaced around the sleeve 26 at approximately 90° intervals. The central portions 3 cross at a central point s, and one of the central portions 30 has a notch 38 therein for receiving the other central portion 30. In this manner, the U-shaped members 28 support the trunk T of the Christmas tree C. Further, a circular projection 40 extends downwardly at the central point 36, and a fastener or screw 42 extends upwardly at the central point 36 through the circular projection 40 and both of the central portions 30 of the U-shaped members 28. When the receptacle 12 is placed over the trunk T of the Christmas tree C, the screw 42 may be screwed into the trunk T to secure the trunk T within the receptacle 12.

A plurality of arms 44 are attached to the receptacle 12 to further secure the trunk T within the receptacle 12. In the preferred and illustrated embodiment, three arms 44 are provided. The arms 44 are circumferentially spaced around the sleeve 26 at approximately 120° intervals. Each arm 44 is attached to an outer upper portion 46 of the sleeve 26 forming a hinge 48 engaged with the arm 44 via a shaft 50 through the arm 44 positioned between a first end 52 and a second end 54 of the arm 44. The first end 52 has a bore 56 for threadably receiving a screw member 58. The second end 54 has a sharp point 60. When the screw member 58 is rotated within the bore 56, the screw member 58 engages an outer portion 62 of the sleeve 26 and causes the second end 54 of the arm 44 to move inwardly toward the trunk T of the Christmas tree C. As the second end 54 of the arm 44 moves inwardly, the sharp point 60 is driven into engagement with the trunk T and thereby secures the trunk T within the receptacle 12.

Figure 4:
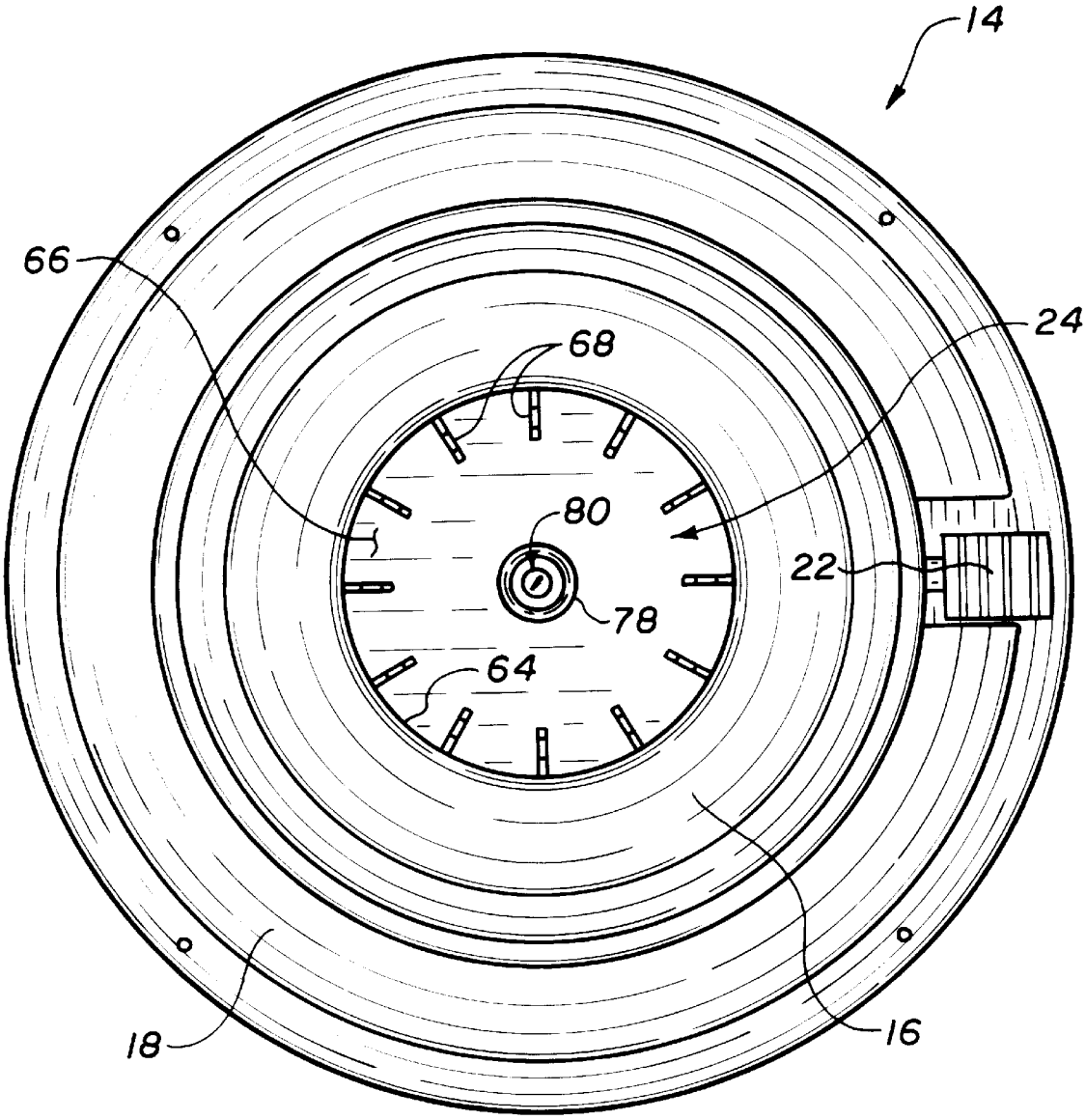
FIG. 4 is a top view of the base of the Christmas tree stand of FIG. 1.

Referring now to FIG. 4, a top view of the base 14 of the Christmas tree stand 10 is illustrated. After the receptacle 12 has been placed over the trunk T of the Christmas tree C and the trunk T has been secured within the receptacle 12, the receptacle 12 is inserted into the cavity 24 in the top portion 16 of the base 14. A receiving wall surface 64 and a receiving floor surface 66 which define the cavity 24 are configured for mating engagement with the receptacle 12. This mating engagement permits the receptacle 12 to be securely positioned within the top portion 16 of the base 14 without the use of additional fasteners.

Figure 5A:
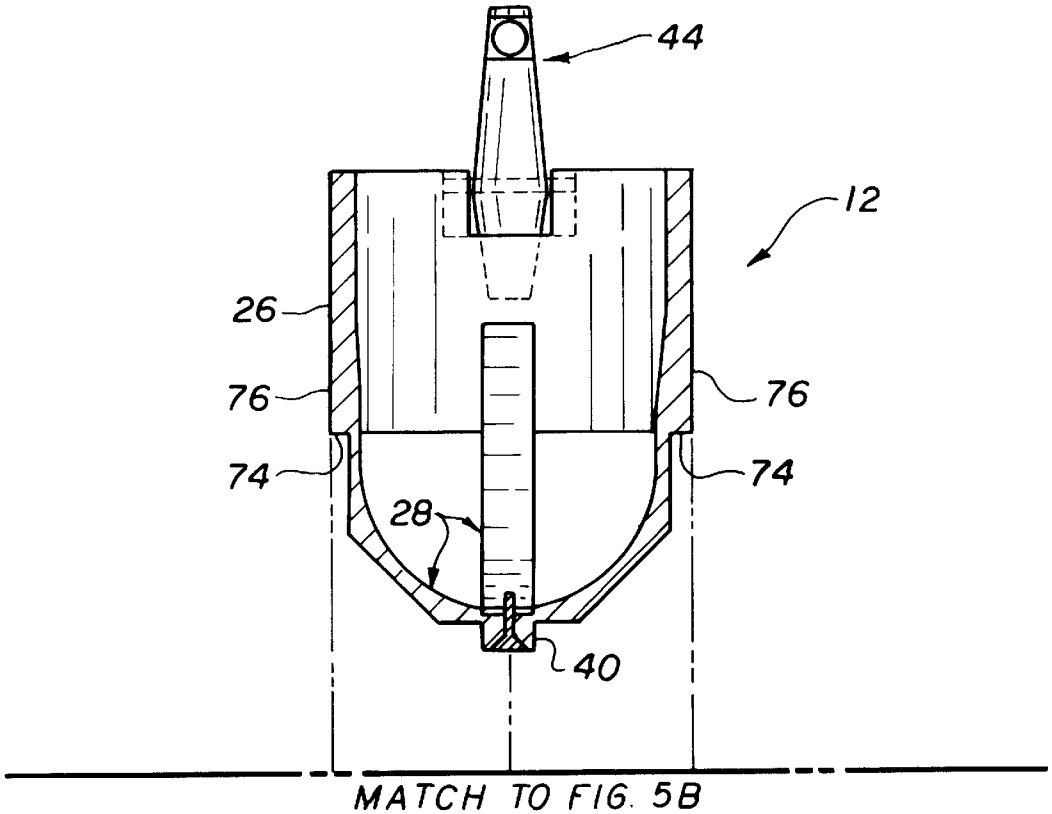
FIGS. 5*a* and 5*b* collectively are an exploded cross-sectional side view of the receptacle in relationship to the base of the Christmas tree stand of FIG. 1.
Figure 5B:
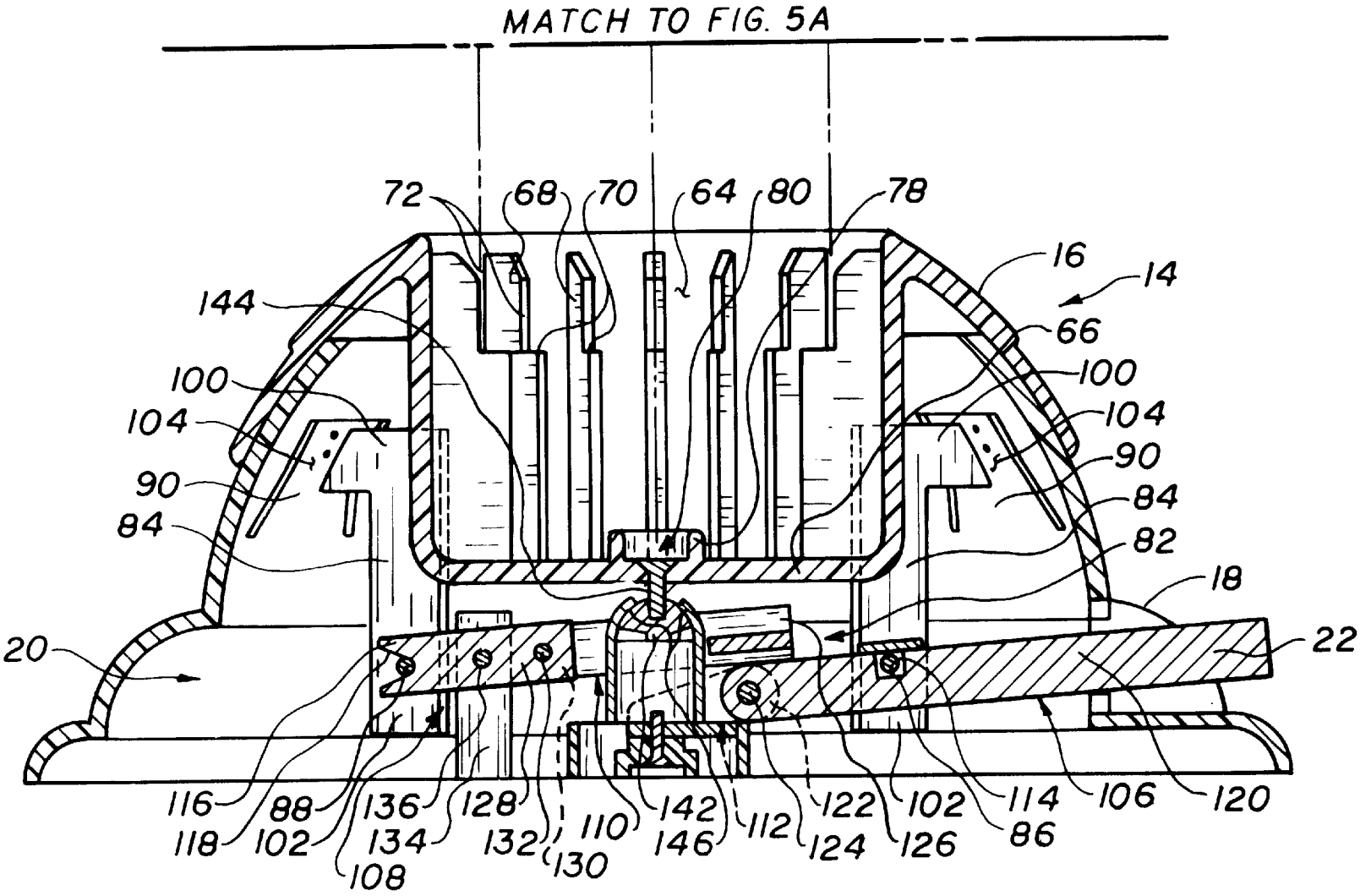
Figure 6:
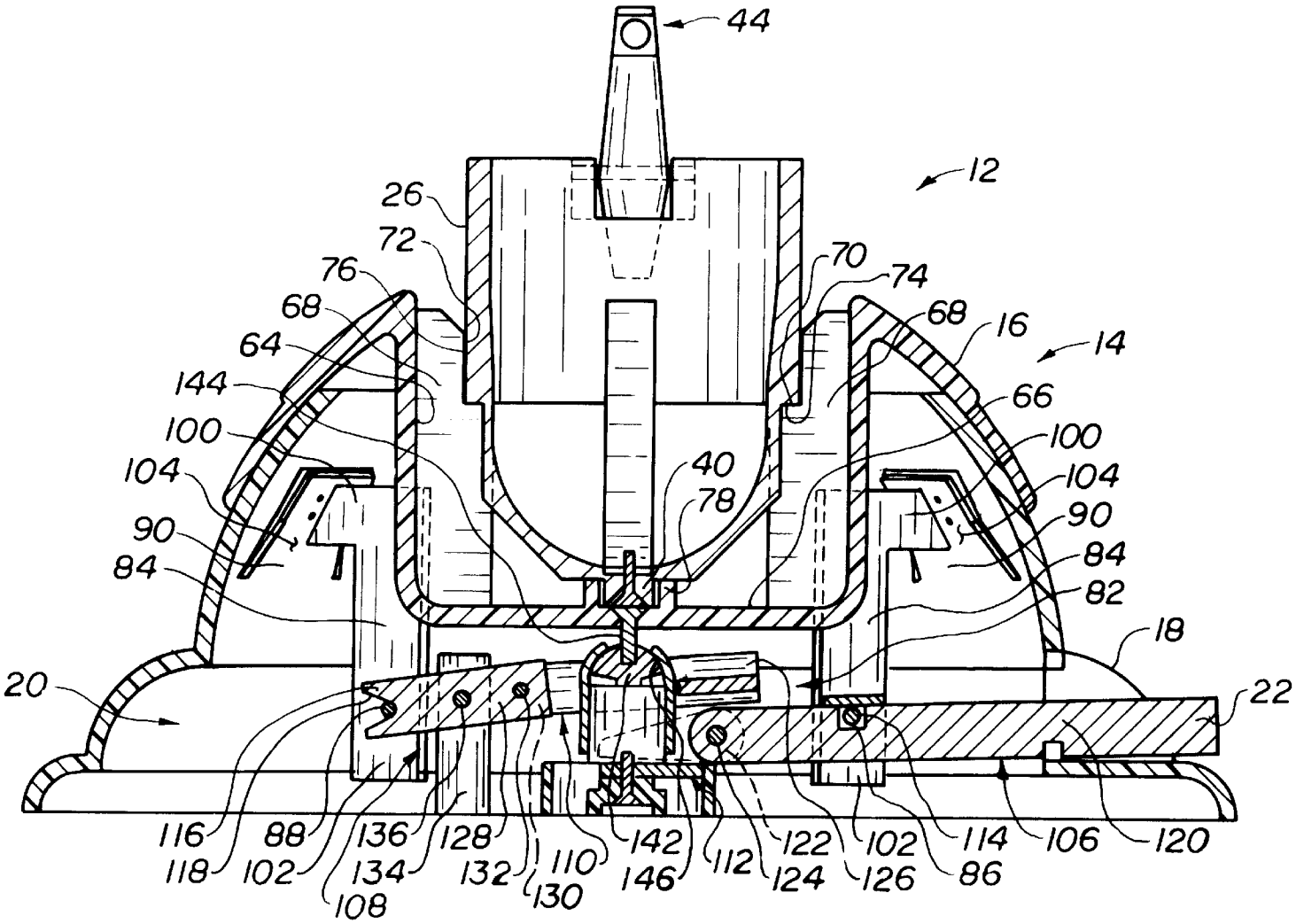
FIG. 6 is a cross-sectional side view of the receptacle inserted into the base of the Christmas tree stand of FIG. 1.

An exploded cross-sectional side view of the receptacle 12 in relationship to the base 14 of the Christmas tree stand 10 and a cross-sectional side view of the receptacle 12 inserted into the base 14 are illustrated in FIGS. 5*a*, 5*b* and 6, respectively. These views illustrate the mating engagement of the respective configurations of the receiving wall surface 64 and the receiving floor surface 66 and the receptacle 12.

As illustrated, the receiving wall surface 64 has a plurality of fins 68 which are circumferentially spaced around the receiving wall surface 64. The fins 68 extend inwardly into the cavity 24. When the receptacle 12 is inserted into the cavity 24, the U-shaped members 28 of the receptacle 12 are interposed between and in mating engagement with adjacent fins 68. The width of the U-shaped members 28 corresponds to the spacing between adjacent fins 68 to ensure mating engagement between the U-shaped members 28 and the adjacent fins 68. In this manner, circumferential movement of the receptacle 12 within the cavity 24 is prevented. Additionally, equivalent spacing is provided between adjacent fins 68 to allow the receptacle 12 to be inserted into the cavity 24 in any position. Each fin 68 has an upwardly facing flange 70 and an inwardly facing surface 72 which abut a bottom edge 74 and an outer lower portion 76, respectively, of the sleeve 26 of the receptacle 12 when the receptacle 12 is inserted into the cavity 24. This configuration of the fins 68 helps to prevent movement of the receptacle 12 within the cavity 24.

As also illustrated in FIGS. 5*a*, 5*b* and 6, the receiving floor surface 66 has a circular ridge 78. The circular ridge 78 forms a depression 80 within which the circular projection 40 is engaged during use of the Christmas tree stand 10. When the receptacle 12 is inserted into the cavity 24, the circular projection 40 is inserted into the depression 80 formed by the circular ridge 78. In this manner, movement of the receptacle 12 within the cavity 24 is further prevented.

The components of the movement assembly 20 and operation of the movement assembly 20 which enables the top portion 16 of the base 14 to move with respect to the bottom portion 18 of the base 14 are illustrated in FIGS. 5*a*, 5*b*–12. The movement assembly 20 includes the following interconnected components: a lever assembly 82 (which includes the foot pedal 22), a plurality of inverted L-shaped members 84, a first rod 86, and a second rod 88.

Figure 7:
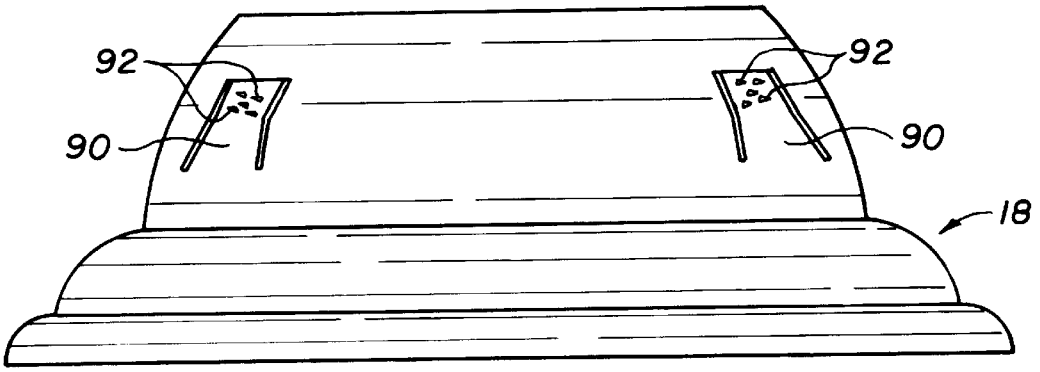
FIG. 7 is a side view of the bottom portion of the base of the Christmas tree stand of FIG. 1.
Figure 10:
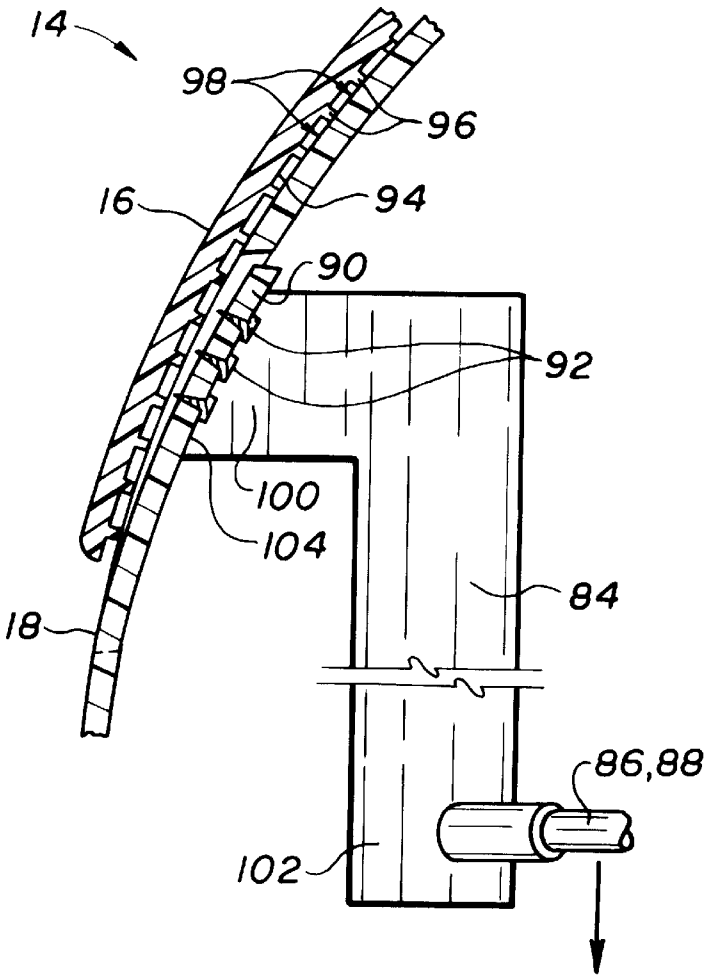
FIG. 10 is a partial cross-sectional side view of the base of the Christmas tree stand of FIG. 1 illustrating the tabs moved inwardly from the bottom portion.
Figure 9:
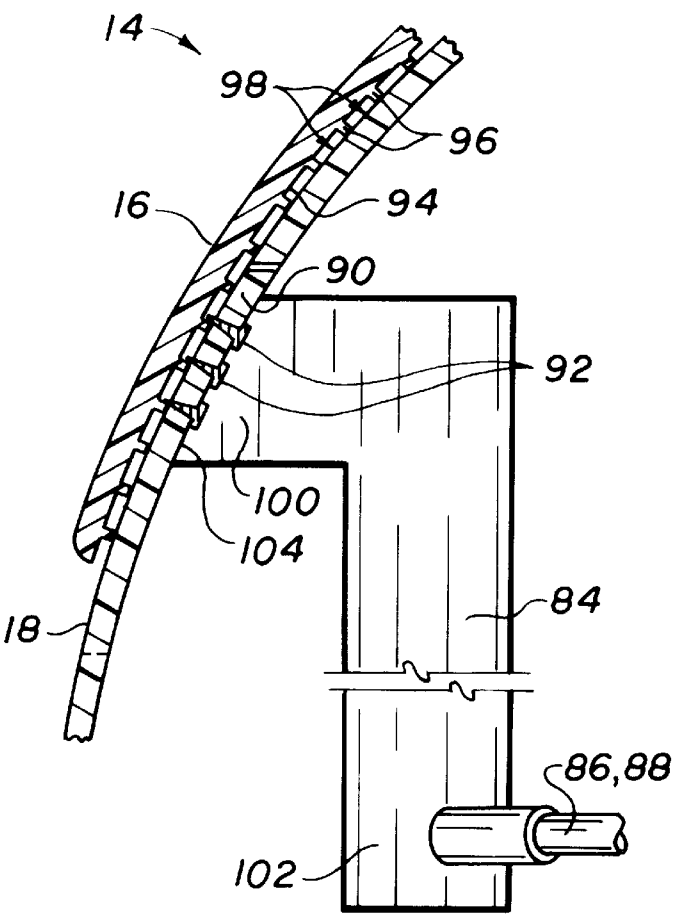
FIG. 9 is a partial cross-sectional side view of the base of the Christmas tree stand of FIG. 1 illustrating the tabs in alignment with the bottom portion.

The movement assembly 20 is interconnected with tabs 90 which, in the preferred embodiment, are integral with the bottom portion 18, as illustrated in FIG. 7. Further, in the preferred and illustrated embodiment, the tabs 90 are circumferentially spaced around the bottom portion 18 at approximately 90° intervals. The tabs 90 have protrusions 92 thereon which project outwardly toward the top portion 16. As illustrated in FIGS. 9 and 10, an inner surface 94 of the top portion 16 has a plurality of radially spaced, concentric, circumferential ridges 96. The ridges 96 form a plurality of adjacent valleys 98 intermediate the ridges 96 in the inner surface 94 of the top portion 16.

Figure 8:
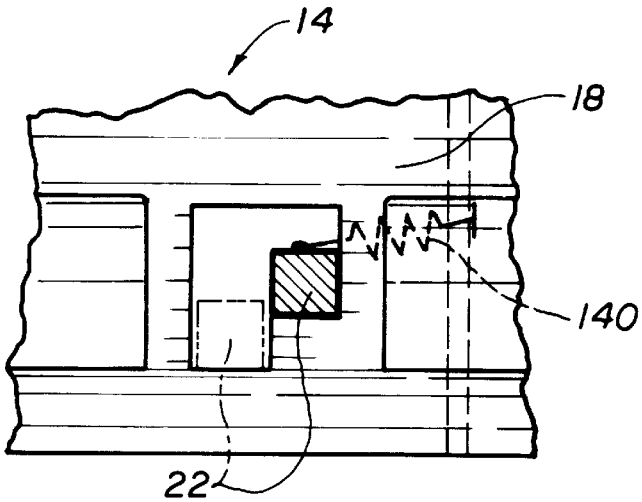
FIG. 8 is a partial view of the base of the Christmas tree stand of FIG. 1 illustrating the two positions of the foot pedal.

As previously stated and as illustrated in FIG. 8, the foot pedal 22 may be moved between a first position and a second position. When the foot pedal 22 is in the first position (illustrated in solid lines in FIG. 8), the tabs 90 are in alignment with the bottom portion 18 (as illustrated in FIG. 9) and the protrusions 92 project outwardly from the bottom portion 18 into the valleys 98 in the top portion 16. In this first position, the protrusions 92 engage with the ridges 96 in the top portion 16 and the top portion 16 is thus prevented from moving with respect to the bottom portion 18.

When the foot pedal 22 is in the second position (illustrated in phantom in FIG. 8), the tabs 90 having the protrusions 92 thereon are moved inwardly (as illustrated in FIG. 10) causing the protrusions 92 to be moved away from and out of engagement with the ridges 96 and the valleys 98 in the top portion 16, and the top portion 16 is thus permitted to move freely with respect to the bottom portion 18. In this second position, the Christmas tree C, secured within the receptacle 12, may be easily adjusted to a desired vertical position by moving the top portion 16 and the receptacle 12 with respect to the bottom portion 18.

FIGS. 5*a*, 5*b*, 6, 11, and 12 further illustrate the operation of the movement assembly 20 which enables the top portion 16 of the base 14 to move with respect to the bottom portion 18 of the base 14. One of the inverted L-shaped members 84 is associated with each of the tabs 90 in the bottom portion 18. Each L-shaped member 84 has a first end 100 and a second end 102. The first end 100 of each L-shaped member 84 is connected to an inner surface 104 of the corresponding tab 90. The second end 102 of each L-shaped member 84 is connected to a rod. In the preferred and illustrated embodiment, the first rod 86 and the second rod 88 interconnect the L-shaped members 84.

The lever assembly 82 extends through the bottom portion 18 of the base 14 and within the bottom portion 18. The lever assembly 82 includes a first lever portion 106, a second lever portion 108, and a pivoting portion 110 which interconnects the first lever portion 106 and the second lever portion 108. The lever assembly 82 further includes a support portion 112. The first lever portion 106 has a bore 114 therein for receiving the first rod 86. An outer end 116 of the second lever portion 108 has a groove 118 therein for receiving the second rod 88. An outer end 120 of the first lever portion 106 is connected to the foot pedal 22. An inner end 122 of the first lever portion 106 is connected to the support portion 112 by means of a first pivot pin 124, and is further connected to a first end 126 of the pivoting portion 110. An inner end 128 of the second lever portion 108 is connected to a second end 130 of the pivoting portion 110 by means of a second pivot pin 132. Restraining blocks 134 are located on each side of the second lever portion 108 and are connected thereto by means of a restraining pin 136. Further, pegs 138 are located in the second rod 88 on each side of the second lever portion 108. Both the restraining blocks 134 and the pegs 138 prevent movement of the second lever portion 108 out of its operating position.

Figure 11:
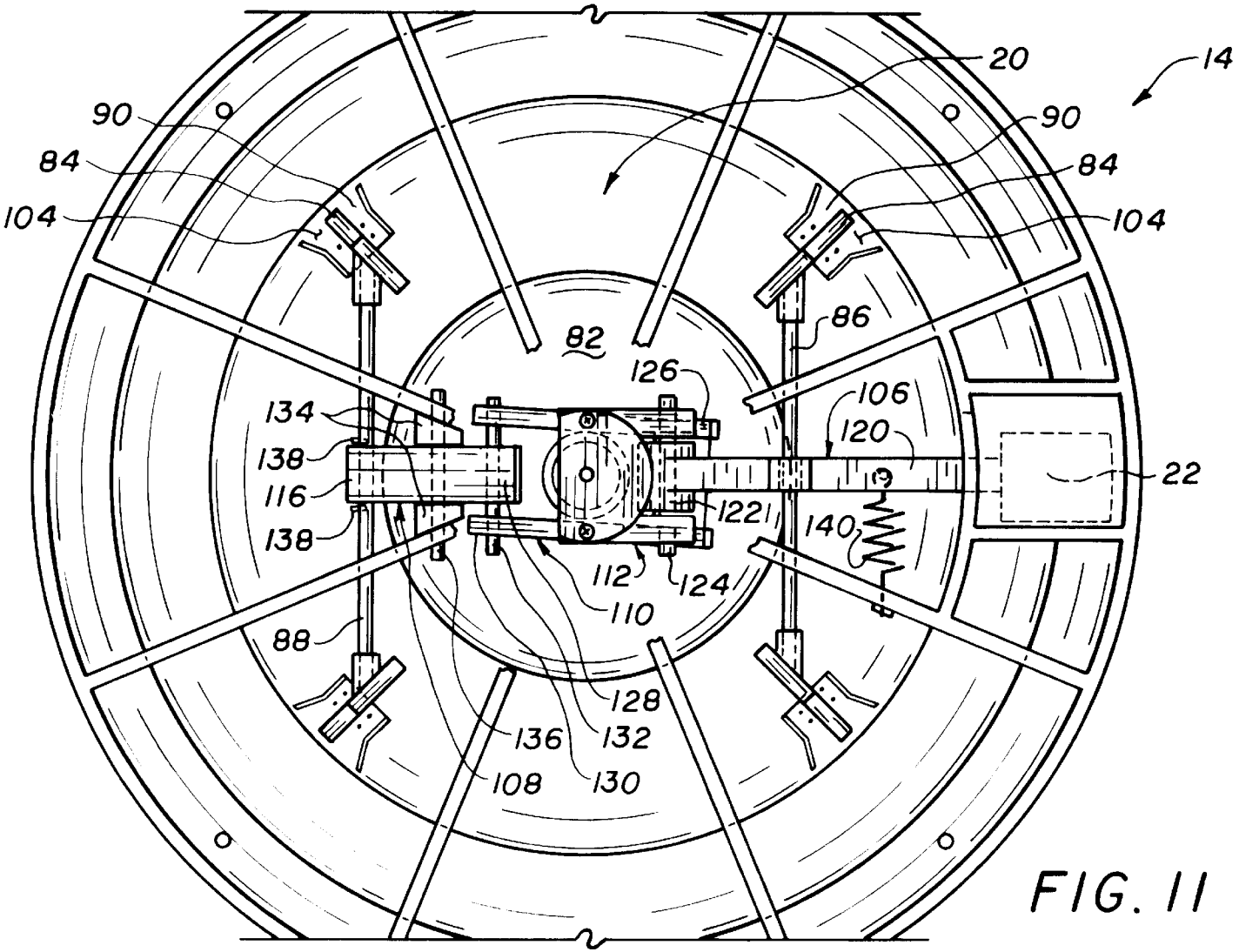
FIG. 11 is a bottom view of the base of the Christmas tree stand of FIG. 1 illustrating the arrangement of the movement assembly when the foot pedal is in the first position.
Figure 12:
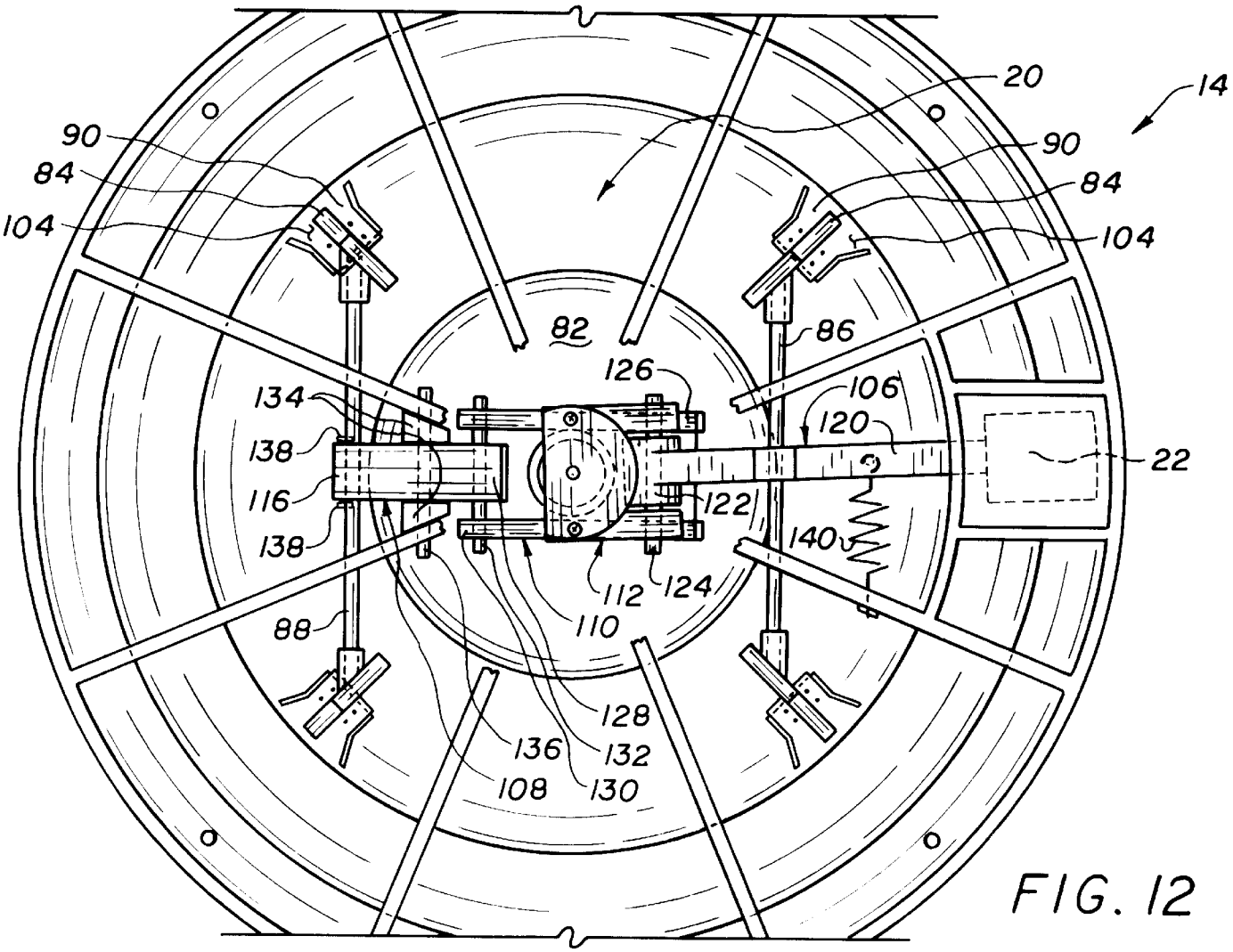
FIG. 12 is a bottom view of the base of the Christmas tree stand of FIG. 1 illustrating the arrangement of the movement assembly when the foot pedal is in the second position.

When the foot pedal 22 is in the first position, the movement assembly 20 is arranged as illustrated in FIGS. 5*a*, 5*b* and 11. When the foot pedal 22 is moved to the second position (i.e., moved to the left and downwardly), the movement assembly 20 is moved to the arrangement illustrated in FIGS. 6 and 12. Specifically, when the foot pedal 22 is moved downwardly, the following chain of events occurs:

(i) the outer end 120 of the first lever portion 106, which is connected to the foot pedal 22, moves downwardly in response to the foot pedal 22 movement;

(ii) the inner end 122 of the first lever portion 106 pivots at the first pivot pin 124 in response to the outer end 120 movement;

(iii) the first end 126 of the pivoting portion 110, which is connected to the inner end 122 of the first lever portion 106, moves downwardly in response to the inner end 122 movement;

(iv) the second end 130 of the pivoting portion 110 moves upwardly in response to the first end 126 movement;

(v) the inner end 128 of the second lever portion 108, which is connected to the second end 130 of the pivoting portion 110 by means of the second pivot pin 132, pivots at the second pivot pin 132 and moves upwardly in response to the second end 130 movement; and (vi) the outer end 116 of the second lever portion 108 moves downwardly in response to the inner end 128 movement.

When the outer end 120 of the first lever portion 106 moves downwardly, the first rod 86 and the L-shaped members 84 connected thereto are pulled downwardly. Similarly, when the outer end 116 of the second lever portion 108 moves downwardly, the second rod 88 and the L-shaped members 84 connected thereto are pulled downwardly. As a result, the tabs 90 having the protrusions 92 thereon are moved inwardly causing the protrusions 92 to be moved away from and out of engagement with the ridges 96 and the valleys 98 in the top portion 16 of the base 14. Thus, the top portion 16 is permitted to move freely with respect to the bottom portion 18. In this position, one person, having one foot on the foot pedal 22 and one hand on the Christmas tree C, may easily adjust the vertical position of the Christmas tree C secured within the receptacle 12 while standing in an upright position where the desired vertical position of the Christmas tree C is readily apparent. When the desired vertical position is obtained by simply moving the Christmas tree C, the foot pedal 22 is released.

When the foot pedal 22 is released, it returns to the first position and the above chain of events reverses itself. A spring 140, which interconnects the first lever portion 106 with the bottom portion 18 of the base 14, ensures that the first lever portion 106, and thus the entire lever assembly 82, returns to its original position. As a result, the tabs 90 are moved to their original positions in alignment with the bottom portion 18 and the protrusions 92 project outwardly from the bottom portion 18 into the valleys 98 in the top portion 16 causing the protrusions 92 to engage with the es 96 in the top portion 16. Thus, the top portion 16 is prevented from moving with respect to the bottom portion 18, and the Christmas tree C secured within the receptacle 12 is maintained in the desired vertical position.

Further, as illustrated in FIGS. 5*a*, 5*b* and 6, the top portion 16 of the base 14 is connected to a ball-like member 142 via a fastener or screw 144. The ball-like member 142 is rotatable within a mating socket member 146 which is connected to the bottom portion 18 of the base 14. Rotation of the ball-like member 142 within the socket member 146 permits the top portion 16 to move with respect to the bottom portion 18 when the foot pedal 22 is in the second position.

Figure 13:
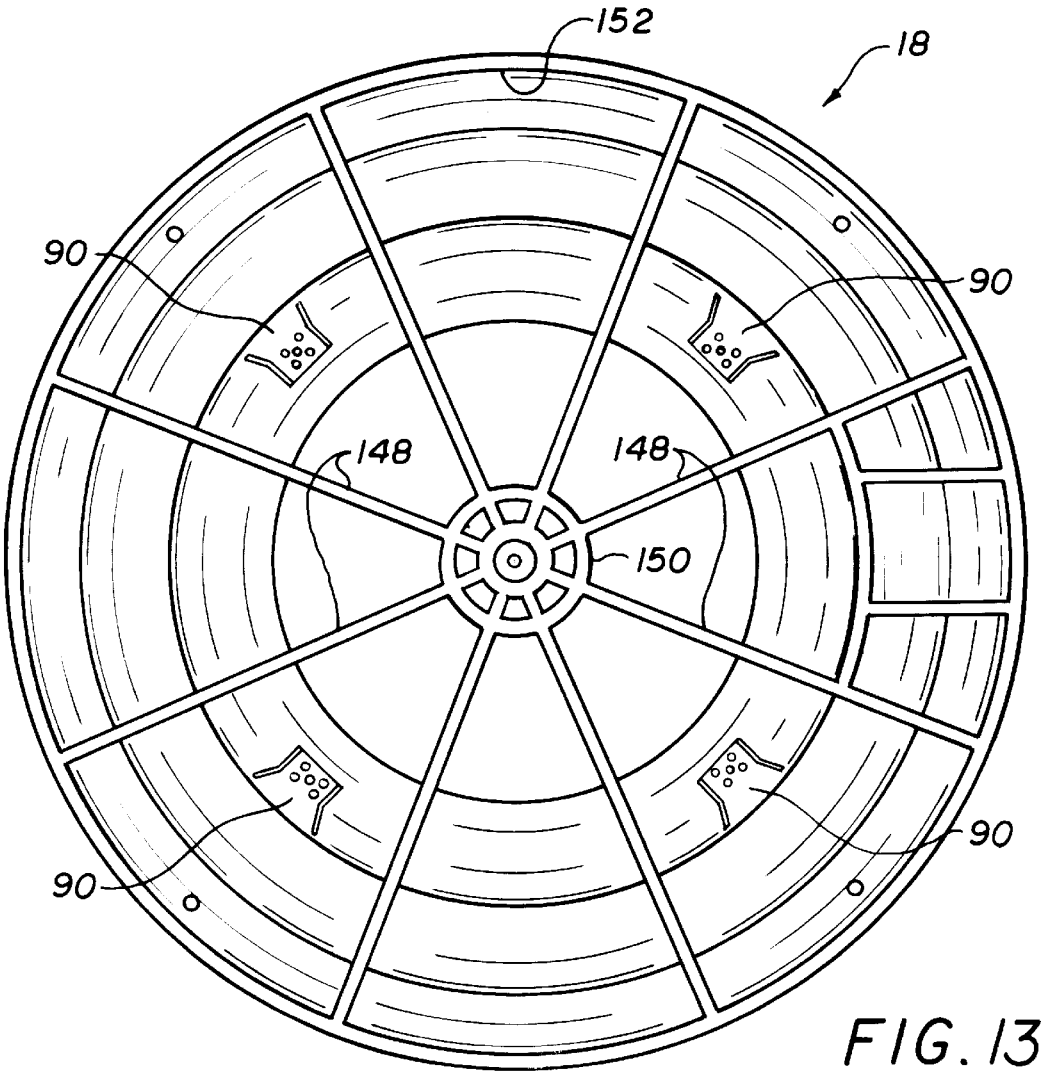
FIG. 13 is a bottom view of the bottom portion of the base of the Christmas tree stand of FIG. 1.
Figure 14:
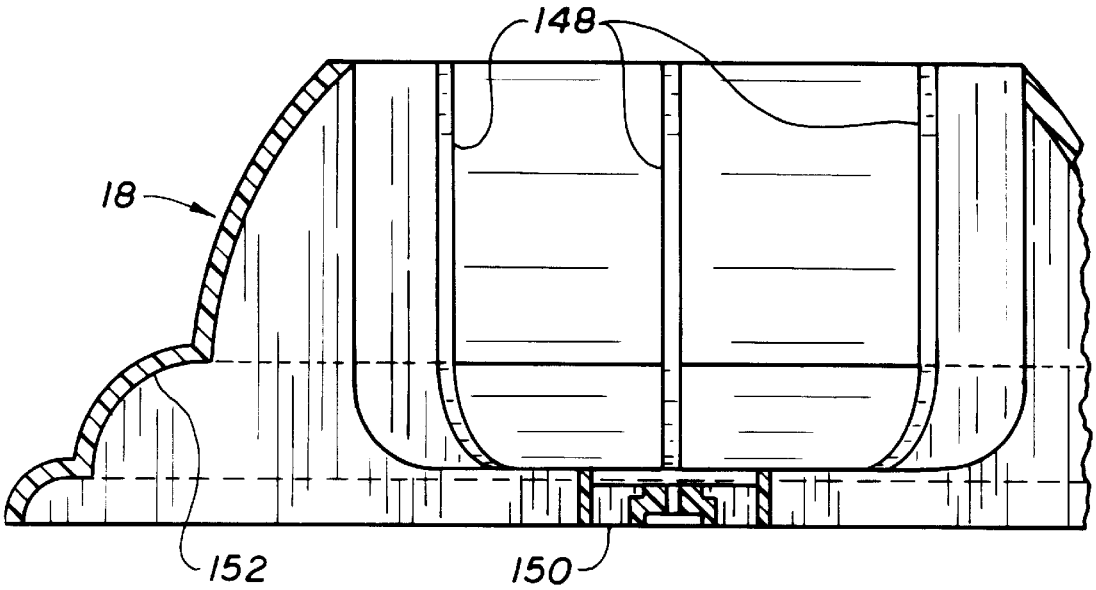
FIG. 14 is a cross-sectional side view of the bottom portion of the base of the Christmas tree stand of FIG. 1.

Referring now to FIGS. 13 and 14, the internal support structure of the base 14 is illustrated having a plurality of ribs 148 radially extending from a central hub 150. Each of the ribs 148 extends from the central hub 150 to an inner surface 152 of the bottom portion 18 of the base 14. Further, each of the ribs 148 extends along the entire vertical length of the inner surface 152.

One may now appreciate that the present invention provides a Christmas tree stand which permits a Christmas tree to be solidly secured within the stand and to be easily adjusted to a desired vertical position.

Although the present invention has been illustrated and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A tree stand for receiving and supporting a tree, said stand comprising a receptacle for receiving the trunk of said tree and a base for supporting said receptacle when said tree is received therein, said receptacle including a clamping assembly for securing said trunk in said receptacle, said base including (a) a top portion for releasably receiving said receptacle, (b) a bottom portion for supporting said top portion, (c) a locking assembly movable between a locking position in which said top portion is prevented from moving with respect to said bottom portion and a disengaged position in which said top portion is permitted to move freely with respect to said bottom portion for moving said tree to a desired vertical position, and (d) a foot pedal for moving said locking assembly from said locking position to said disengaged position when said foot pedal is depressed.

2. A tree stand for supporting and positioning a tree, said stand comprising:

a receptacle defining a space therein for receiving the trunk of said tree, a base receiving said receptacle, said base supporting said receptacle for rotation of said receptacle about a pivot point located below said space when said receptacle is received in said base for vertically positioning said tree, a locking assembly movable between a disengaged position for allowing said receptacle to be moved with respect to said base to a desired position for vertically positioning said tree and a locking position for locking said receptacle in place with respect to said base, said locking assembly causing a force to be exerted on said receptacle above said pivot point to prevent movement of said receptacle when said locking assembly is in said locking position, and a foot pedal operatively connected to said locking assembly for moving said locking assembly from said locking position to said disengaged position when said foot pedal is depressed.

3. The tree stand of claim 2, further comprising a clamping assembly connected to said receptacle for securing the trunk of said tree within said receptacle.

4. The tree stand of claim 3, wherein said receptacle has a top, a bottom and side surfaces therebetween, said locking assembly causing a force to be exerted on said side surfaces to prevent movement of said receptacle with respect to said pivot point when said locking assembly is in said locking position.

5. The tree stand of claim 2, wherein said receptacle is releasably received in said base.

6. A tree stand for supporting and positioning a tree, said stand comprising:

a receptacle for receiving the trunk of said tree, a base receiving said receptacle, said base pivotally mounting said receptacle for vertically positioning said tree, a locking assembly movable between a disengaged position for allowing said receptacle to be moved with respect to said base to a desired position for vertically positioning said tree and a locking position for locking said receptacle in place with respect to said base, said locking assembly causing a force to be exerted on side surfaces of said receptacle to prevent movement of said side surfaces when said locking assembly is in said locking position, and a foot pedal operatively connected to said locking assembly for moving said locking assembly from said locking position to said disengaged position when said foot pedal is depressed.

7. The tree stand of claim 6, wherein said base comprises an upper base portion and a lower base portion, said upper base portion receiving said receptacle, said locking assembly causing said upper base portion to exert a force on the side surfaces of said receptacle thereby preventing movement of said receptacle when said locking assembly is in said locking position.

8. The tree stand of claim 6, wherein said base releasably receives said receptacle.

9. The tree stand of claim 6, wherein said receptacle is releasably received with in said base.

10. The tree stand of claim 6, wherein said receptacle comprises an annular sleeve which substantially surrounds the trunk of said tree and at least one U-shaped member attached to said annular sleeve and extending downwardly therefrom which engages the trunk of the tree.

11. The tree stand of claim 6, further comprising a clamping assembly connected to said receptacle for securing the trunk of said tree within said receptacle.

12. The tree stand of claim 11, wherein said clamping assembly comprises a plurality of arms, each of said arms being hingedly attached to said receptacle between a first end and a second end, each of said second ends having a point thereon for engagement into a trunk of the tree upon movement of said second ends toward the trunk to secure the trunk of the tree within said receptacle.

13. The tree stand of claim 12, wherein said arms are attached to an upper portion of said receptacle and extend above said receptacle to engage said points on said second ends into the trunk of the tree spaced above said upper portion of said receptacle.

14. The tree stand of claim 12, wherein said clamping assembly comprises three arms, said arms being circumferentially spaced around said sleeve at approximately 120 degree intervals.

15. A tree stand for supporting and positioning a tree, said stand comprising:

a receptacle for receiving the trunk of said tree, a base receiving said receptacle, said base pivotally mounting said receptacle for vertically positioning said tree, a locking assembly movable between a disengaged position for allowing said receptacle to be moved to a desired position for vertically positioning said tree and a locking position for locking said receptacle in place with respect to said base, and a foot pedal attached to said locking assembly for moving said locking assembly from said locking position to said disengaged position when said foot pedal is depressed, said tree stand further including (1) a foundation for carrying the weight of said receptacle and said tree when said stand is placed on a floor or other surface, and (2) an engagement section receiving said receptacle such that movement of said engagement section with respect to said receptacle is prevented as said receptacle pivotally moves with respect to said base for vertically positioning said tree, and further wherein said engagement section defines at least one engagement surface and said locking assembly includes at least one locking element for engaging said at least one engagement surface.

16. The tree stand of claim 15, wherein said at least one engagement surface defines a plurality of indentations therein, said at least one locking element engaging a selected indentation in said at least one engagement surface depending on the position of said receptacle with respect to said base when said locking assembly is in a locking position.

17. A tree stand for supporting and positioning a tree, said stand comprising:

a receptacle for receiving the trunk of said tree, a base releasably receiving said receptacle, said base pivotally mounting said receptacle for vertically positioning said tree, said base including a bottom portion and a top portion movable with respect to said bottom portion, said top portion receiving said receptacle such that said receptacle is prevented from movement with respect to said top portion as said receptacle pivotally moves for vertically positioning said tree, a locking assembly movable between a disengaged position for allowing said receptacle to be moved to a desired position for vertically positioning said tree and a locking position for locking said receptacle in place with respect to said base, and a foot pedal attached to said locking assembly for moving said locking assembly from said locking position to said disengaged position when said foot pedal is depressed.

18. The tree stand of claim 17, wherein said top portion of said base has a cavity for receiving said receptacle.

19. The tree stand of claim 18, wherein said receptacle and a receiving surface of said top portion defining said cavity are configured for mating engagement to engage said receptacle with said top portion of said base without the use of fasteners.

20. The tree stand of claim 18, wherein said cavity is watertight.

21. A tree stand for supporting and positioning a tree, said stand comprising:

a receptacle for receiving the trunk of said tree, a base portion, said receptacle being secured within said stand for rotary movement in any direction with respect to said base portion for vertically positioning said tree, said stand including at least one element securely engaged with said receptacle when said receptacle is secured within said stand for movement with respect to said base portion, said at least one element defining a plurality of spaced ridges and valleys therebetween, a locking assembly movable between a disengaged position for allowing said receptacle to be moved to a desired position for vertically positioning said tree and a locking position for locking said receptacle in place with respect to said base portion, said locking assembly including at least one protrusion for engaging at least one of said valleys when said locking assembly is in said locking position, and a foot pedal attached to said locking assembly for moving said at least one protrusion out of engagement with said at least one valley when said locking assembly is moved from said locking position to said disengaged position.

22. The tree stand of claim 21, wherein said receptacle pivots with respect to said base portion about a pivot point, said at least one element defining an engagement surface lying on a sphere centered about said pivot point, said ridges and said valleys being defined in a portion of said engagement surface.

23. The tree stand of claim 22, wherein said base portion defines a spherical surface, said at least one engagement surface engaging said spherical surface.

24. A tree stand for supporting and positioning a tree, said stand comprising:

a receptacle for receiving and holding the trunk of said tree;

a base to mount the receptacle for selective movement in the base to vertically position the tree, a locking assembly having an adjustment position allowing the receptacle to be moved, and a locking position allowing the locking assembly to hold the receptacle and tree in the selected vertical position, said locking assembly further having a first portion with at least one projection and a second portion with at least one recess; and a foot pedal on the base operative to move the locking assembly between its two positions by creating relative motion between the first and second portions whereby the at least one projection is received in the at least one recess in the locking position and is removed from the at least one recess in the adjustment position.

25. The tree stand of claim 24 wherein said first portion has a plurality of projections and said second portion has a plurality of recesses selectively receiving said projections to create a lock therebetween.

26. A tree stand for supporting and positioning a tree, said stand comprising:

a receptacle defining a space therein for receiving the trunk of said tree, a clamping assembly connected to said receptacle for securing the trunk of said tree within said receptacle, a base receiving said receptacle, said base supporting said receptacle for rotation of said receptacle about a pivot point located below said space when said receptacle is received in said base for vertically positioning said tree, a locking assembly movable between a disengaged position for allowing said receptacle to be moved with respect to said base to a desired position for vertically positioning said tree and a locking position for locking said receptacle in place with respect to said base, said locking assembly causing a force to be exerted on said receptacle above said pivot point to prevent movement of said receptacle when said locking assembly is in said locking position, and a foot pedal attached to said locking assembly for moving said locking assembly from said locking position to said disengaged position when said foot pedal is depressed.

27. A tree stand for positioning a tree, said stand comprising:

a container for receiving the trunk of said tree, an engagement section integral with said container when said tree is mounted in said tree stand, said engagement section having at least one engagement surface defining a plurality of indentations therein for engaging the locking element of a locking assembly;

a foundation for supporting said receptacle, said receptacle being movable in said foundation for vertically positioning said tree, a locking assembly for preventing movement of said receptacle when said locking assembly is in a locking position, said locking assembly including at least one locking element for engaging a selected indentation in said at least one engagement surface depending on the position of said receptacle with respect to said base, and an actuator for moving said locking assembly to a disengaged position in which said at least one locking element is disengaged from said indentations for vertically positioning said tree to a locking position in which said at least one locking element is received in a selected indentation in said at least one engagement surface for securing said receptacle in place.

28. The tree stand of claim 27, wherein said actuator is a foot pedal.

* * * * *